US011547253B2

(12) United States Patent
May

(10) Patent No.: US 11,547,253 B2
(45) Date of Patent: Jan. 10, 2023

(54) DISPENSING CONTAINER

(71) Applicant: THE CLOROX COMPANY, Oakland, CA (US)

(72) Inventor: Glenn P. May, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 81 days.

(21) Appl. No.: 16/748,059

(22) Filed: Jan. 21, 2020

(65) Prior Publication Data

US 2021/0219793 A1 Jul. 22, 2021

(51) Int. Cl.
*A47K 10/38* (2006.01)
*A47K 10/32* (2006.01)

(52) U.S. Cl.
CPC .. *A47K 10/3827* (2013.01); *A47K 2010/3266* (2013.01)

(58) Field of Classification Search
CPC ..... A47G 19/2222; A47K 10/3827; A47K 10/3818; A47K 2010/3266
USPC ..... 221/302, 63, 48, 47, 46, 283, 197, 287; 206/233, 494, 440, 497
See application file for complete search history.

(56) References Cited

U.S. PATENT DOCUMENTS 2,004,614 A * 6/1935 Meagher ..... A47K 10/3818 206/63.5
3,749,296 A 7/1973 Harrison
3,986,479 A * 10/1976 Bonk ..... B65D 43/169 118/506
4,017,002 A * 4/1977 Doyle ..... B65D 83/0805 D7/511
4,158,412 A * 6/1979 Wysocki ..... B65D 5/542 229/242
4,180,160 A * 12/1979 Ogawa ..... A47K 10/3818 225/106
4,200,200 A * 4/1980 Hein, III ..... A47K 10/421 229/940
4,337,876 A * 7/1982 Thompson ..... A47K 10/3818 221/36
4,411,374 A * 10/1983 Hotchkiss ..... A47K 10/3827 221/45
4,534,491 A * 8/1985 Norton ..... A47K 10/3818 221/310
4,768,679 A * 9/1988 Matsui ..... A47K 10/424 221/48
4,785,970 A * 11/1988 Engelmayer ..... B65D 83/0805 221/63
4,848,575 A * 7/1989 Nakamura ..... B65D 83/0805 206/449
4,884,717 A * 12/1989 Bussard ..... B65D 47/06 426/115
5,219,421 A * 6/1993 Tipping ..... B65D 83/0805 206/233

(Continued)

FOREIGN PATENT DOCUMENTS

WO WO-2007105181 A1 * 9/2007 ..... A47K 10/42

*Primary Examiner* — Rakesh Kumar
(74) *Attorney, Agent, or Firm* — Workman Nydegger

(57) ABSTRACT

Disclosed is a container assembly to enclose a volume. The container assembly includes a container, which may be substantially rigid, and an access portal. The access portal or aperture may be covered with a lid that is configurable in a sealed configuration, a closed configuration, and an open configuration.

19 Claims, 14 Drawing Sheets

(56) References Cited

U.S. PATENT DOCUMENTS 5,316,177 A * 5/1994 Boldt ..... B65D 83/0805 206/233
5,325,992 A * 7/1994 Koller ..... B65B 61/12 221/33
5,415,320 A * 5/1995 North ..... B65D 83/0894 221/63
5,462,197 A * 10/1995 Pound ..... B65D 83/0894 221/49
5,467,893 A * 11/1995 Landis, II ..... A47K 10/3818 221/102
5,497,903 A * 3/1996 Yoneyama ..... A47K 10/421 221/48
5,516,001 A * 5/1996 Muckenfuhs ..... B65D 83/0805 221/63
5,718,353 A * 2/1998 Kanfer ..... A47K 10/3818 221/63
5,803,249 A * 9/1998 Harsanyi, Jr. ..... A47K 10/3818 206/812
5,908,138 A * 6/1999 Vlahakis ..... B65D 83/0805 206/409
D414,637 S * 10/1999 Amundson ..... D9/734
6,056,235 A * 5/2000 Brozinsky ..... A47K 10/32 242/598.6
6,135,842 A * 10/2000 LaFata ..... A63H 33/28 446/16
6,189,730 B1 * 2/2001 McClymonds .... A47K 10/3818 221/197
D443,451 S 6/2001 Buck et al.
D444,063 S 6/2001 Buck et al.
D446,452 S 8/2001 Buck et al.
6,279,775 B1 * 8/2001 Parkes ..... A47K 10/3818 221/185
6,318,590 B1 * 11/2001 McMurray-Stivers ..... B65D 83/0805 224/400
6,338,315 B1 * 1/2002 Stillman ..... A01K 39/014 119/51.01
6,364,101 B1 4/2002 Schultz
6,409,044 B1 6/2002 Brown et al.
6,412,656 B1 * 7/2002 Placik ..... B65D 83/0805 221/33
6,523,690 B1 * 2/2003 Buck ..... A47K 10/421 206/494
6,550,633 B2 * 4/2003 Huang ..... A47K 10/42 221/45
6,585,131 B2 7/2003 Huang et al.
6,588,626 B2 * 7/2003 Sauer ..... B65D 5/4208 221/49
6,592,004 B2 7/2003 Huang et al.
6,604,651 B2 * 8/2003 Amundson ..... B65D 33/2591 206/233
6,758,368 B2 * 7/2004 Sarbo ..... B65D 83/0805 221/47
6,766,919 B2 * 7/2004 Huang ..... B65D 83/0805 221/63
6,886,714 B2 * 5/2005 Kruchoski ..... B65D 83/0805 221/302
6,889,867 B1 * 5/2005 Smith ..... B65D 43/0212 221/306
7,204,450 B1 * 4/2007 Mallory ..... B65H 55/043 206/390
7,303,069 B2 * 12/2007 Forrest, Jr. ..... B08B 1/00 221/63
7,303,092 B2 * 12/2007 Sarbo ..... B65D 83/0805 221/49
7,380,687 B2 * 6/2008 FitzSimons ..... A47K 10/38 221/199
7,559,434 B2 * 7/2009 Masting ..... A47K 10/3809 221/92
7,597,213 B2 * 10/2009 McDonald ..... B65D 83/0805 220/229
7,624,881 B2 * 12/2009 Wilfong, Jr. ..... A47F 13/085 221/26
7,699,214 B2 * 4/2010 Mestre ..... B65D 5/549 229/232
7,766,168 B2 * 8/2010 Thrapp ..... A45F 5/021 206/496
8,215,089 B2 * 7/2012 Stravitz ..... B65F 1/0006 53/567
8,495,835 B2 * 7/2013 Timmons ..... E06B 7/32 160/180
8,573,398 B2 * 11/2013 Reinke ..... A47K 10/421 206/494
9,457,936 B2 10/2016 Curtin
9,487,340 B2 * 11/2016 Castela ..... B65D 83/0805
9,549,646 B2 * 1/2017 Ray ..... A47K 10/3818
9,694,554 B2 * 7/2017 Mulvey ..... B31D 5/0043
10,150,604 B2 * 12/2018 Parellada Armela ..... B65B 11/004
10,167,111 B2 * 1/2019 Rodon ..... B65D 43/16
10,766,687 B2 * 9/2020 Simmons ..... B65D 75/5833
2002/0096534 A1 * 7/2002 Amundson ..... B65D 33/2591 221/63
2002/0139705 A1 * 10/2002 Hajianpour ..... B65D 77/0453 206/494
2003/0015543 A1 * 1/2003 Turbett ..... A47K 10/424 221/63
2003/0136793 A1 * 7/2003 Chen ..... B65D 33/001 221/63
2003/0146231 A1 * 8/2003 Sarbo ..... B65D 83/0805 221/63
2003/0196984 A1 * 10/2003 Uchiyama ..... B65D 47/36 215/247
2004/0099681 A1 5/2004 Julius
2005/0205593 A1 * 9/2005 Young ..... A47K 10/422 221/33
2005/0263523 A1 * 12/2005 Moss ..... B65D 51/00 220/229
2006/0049067 A1 * 3/2006 McDonald ..... B65D 83/0805 229/125.015
2006/0131319 A1 * 6/2006 McDonald ..... B65D 83/0805 221/63
2006/0180596 A1 * 8/2006 Young ..... A47K 10/423 221/63
2007/0215631 A1 * 9/2007 Bendor ..... A47K 10/421 221/63
2007/0215632 A1 * 9/2007 Bendor ..... A47K 10/42 221/63
2007/0284266 A1 12/2007 McDonald et al.
2008/0041851 A1 * 2/2008 Thrapp ..... B65F 1/141 220/229
2008/0314920 A1 * 12/2008 Rodrigues ..... A61B 42/40 221/63
2010/0133287 A1 * 6/2010 Tramontina ..... A47K 10/3818 221/45
2012/0160864 A1 6/2012 Shoaf et al.
2013/0233858 A1 * 9/2013 Elberg ..... A47G 19/2222 220/710
2017/0129660 A1 5/2017 Hsu
2018/0042432 A1 * 2/2018 Dansreau ..... A47K 10/3818
2019/0069732 A1 3/2019 Miura
2019/0269284 A1 9/2019 Weiss
2021/0219793 A1 * 7/2021 May ..... A47K 10/3827

* cited by examiner

DISPENSING CONTAINER

FIELD

Disclosed is a container assembly, and particularly a container and access assembly for a dispensable item.

BACKGROUND

This section provides background information related to the present disclosure which is not necessarily prior art.

A container may be used to hold a plurality of items that may be dispensed over time. For example, a container may have a large and easy access opening to access, at a selected rate, an internal volume or number of items within the internal volume. For example, a facial tissue container may include a large access to retrieve, substantially individually, facial tissues from the container. The large access allows for easy access to the plurality of facial tissues without disregard to any moisture leaving and/or being absorbed by the facial tissues.

Containers with large openings that allow for easy access to items in the container, however, may allow for quick drying or evaporation of liquid from items within the container. In the alternative, a container may have a small or minimal opening. The small or minimal opening, however, may restrict access to the items or material within the container.

Further, containers include a removable or separate lid to close the container. An opening in the container—may require a removable lid to allow the container to be closed. The container, therefore, may have an opening that is closed with a separately moveable lid.

SUMMARY

This section provides a general summary of the disclosure, and is not a comprehensive disclosure of its full scope or all of its features.

A container and access portal allowing for ease of access to an internal volume of a container while minimizing air transfer between the internal volume and an external volume, relative to the container. Accordingly, the disclosed system allows for ease of access to items within the container while minimizing a drying effect of an external atmosphere on items within the container. The container, therefore, may include wetted or liquid filled items that may retain a selected wetness or moisture content in a volume of liquid over a selected period of time while allowing ease of access by a user to an internal volume of the container.

A container may include any selected volume and provided in any appropriate shape, such as a cylindrical container. Items may be placed in the container in a selected manner such as in a continuously dispensable configuration. For example, a plurality of towels or towelettes may be frangibly or breakably connected and may be positioned in the cylindrical container. A lid or access panel may be provided to allow access to the internal volume of the container to access the plurality of towelettes to remove them or dispense them from the container. The container may also be substantially liquid proof such that a volume of liquid or fluid may be positioned within the container to moisten the towelettes to a selected amount.

An access panel or access lid may be provided on the container to allow access to the plurality of towelettes. The access panel may include an opening that allows ease of access, such as with a hand of a user, to the towelettes within the container. The opening or lid may have an openable portion, such as a frangible or breakable leaves or petals. The petals or leaves allow for the user to access the internal volume of the container to retrieve towelettes in a selected manner. The lid may be closed or substantially sealed in a first configuration and unsealed in a second configuration, such as by the user. The user, in various embodiments, may open or unseal the lid to allow for access to the towelettes within the container. The lid may be initially provided in a substantially sealed configuration and even maintained in a closed configuration after unsealing by the user.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
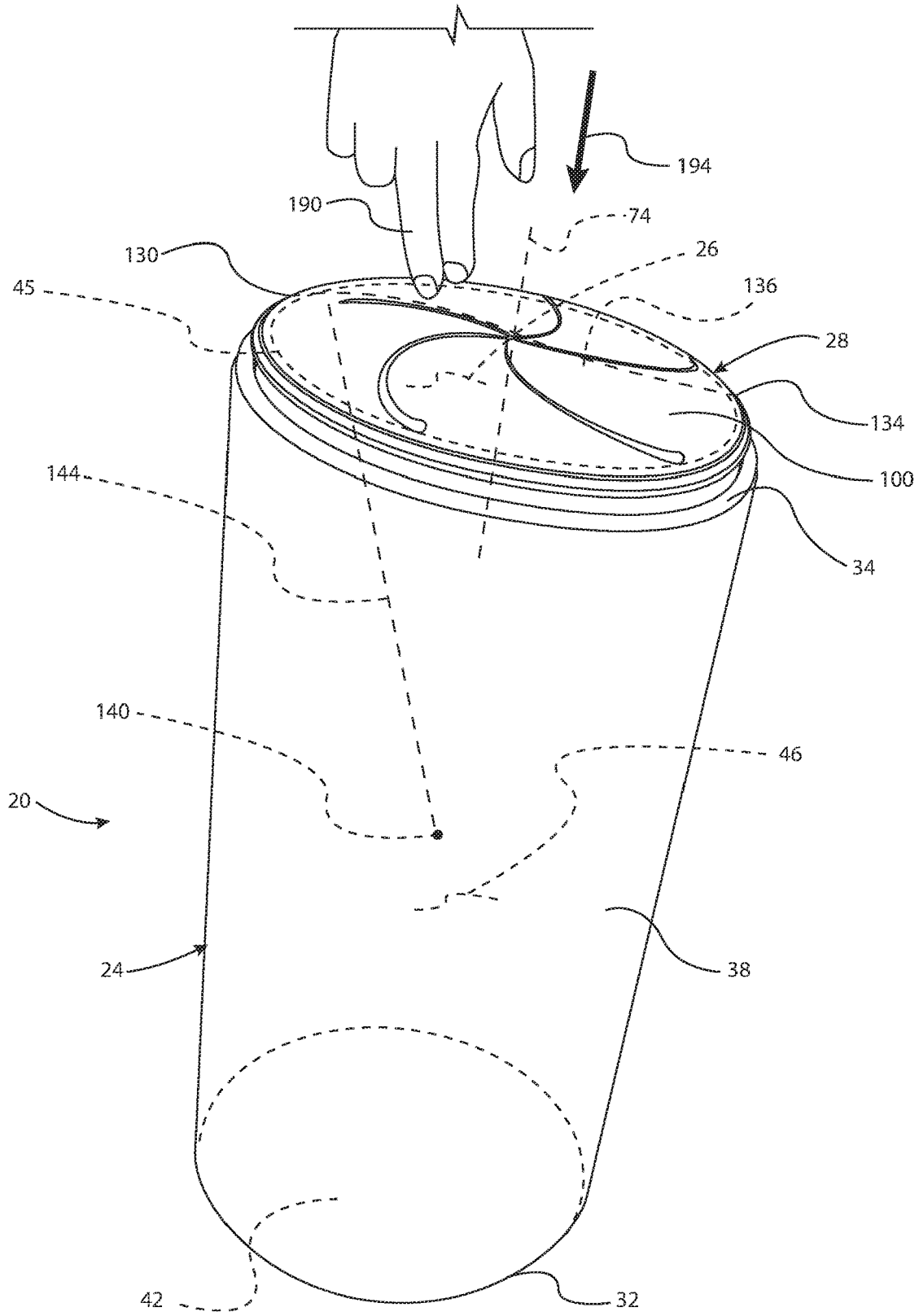
FIG. 1 is a top perspective view of a container assembly, according to various embodiments.
Figure 2:
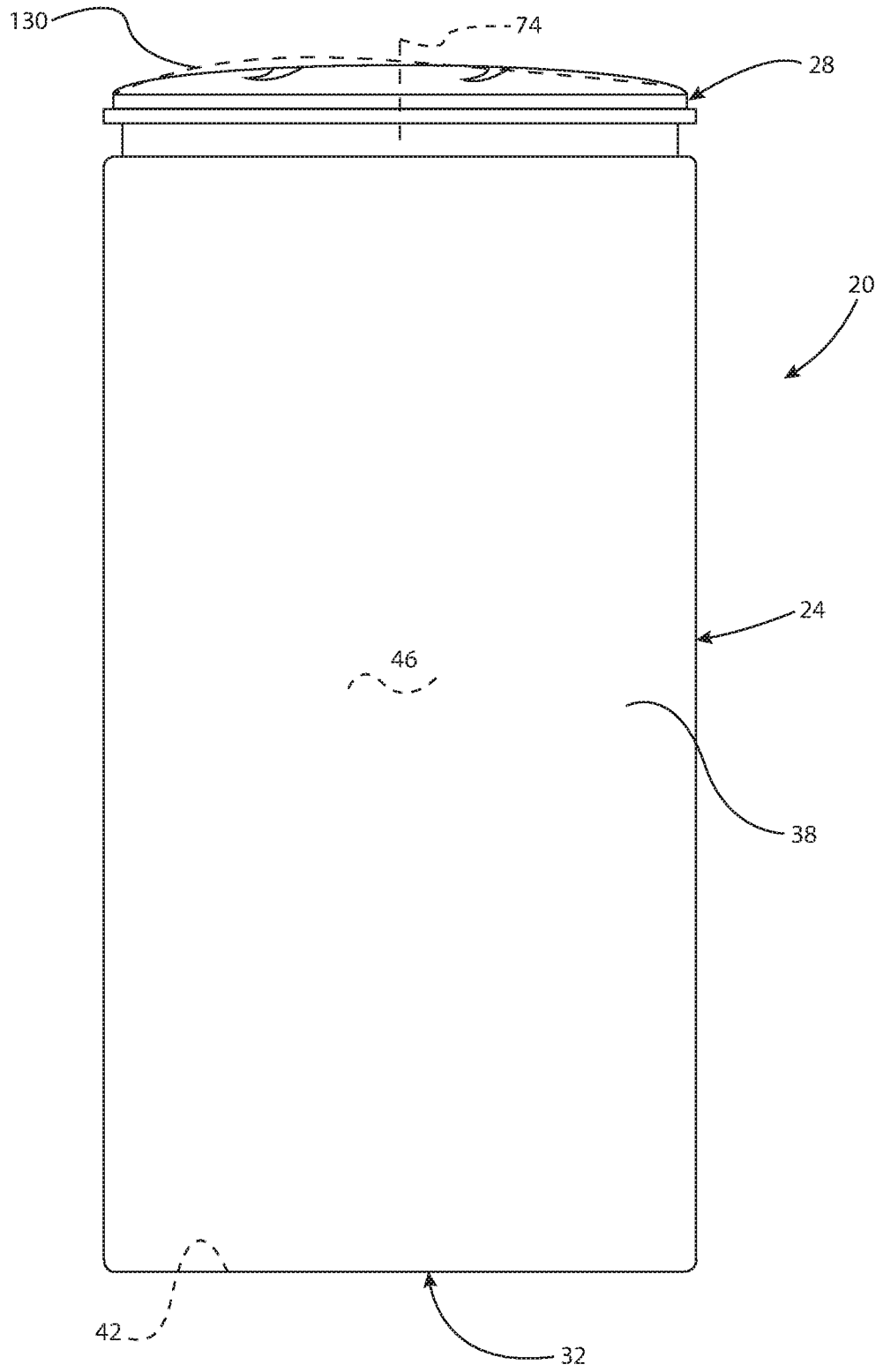
FIG. 2 is a side elevation view of a container assembly, according to various embodiments.
Figure 3:
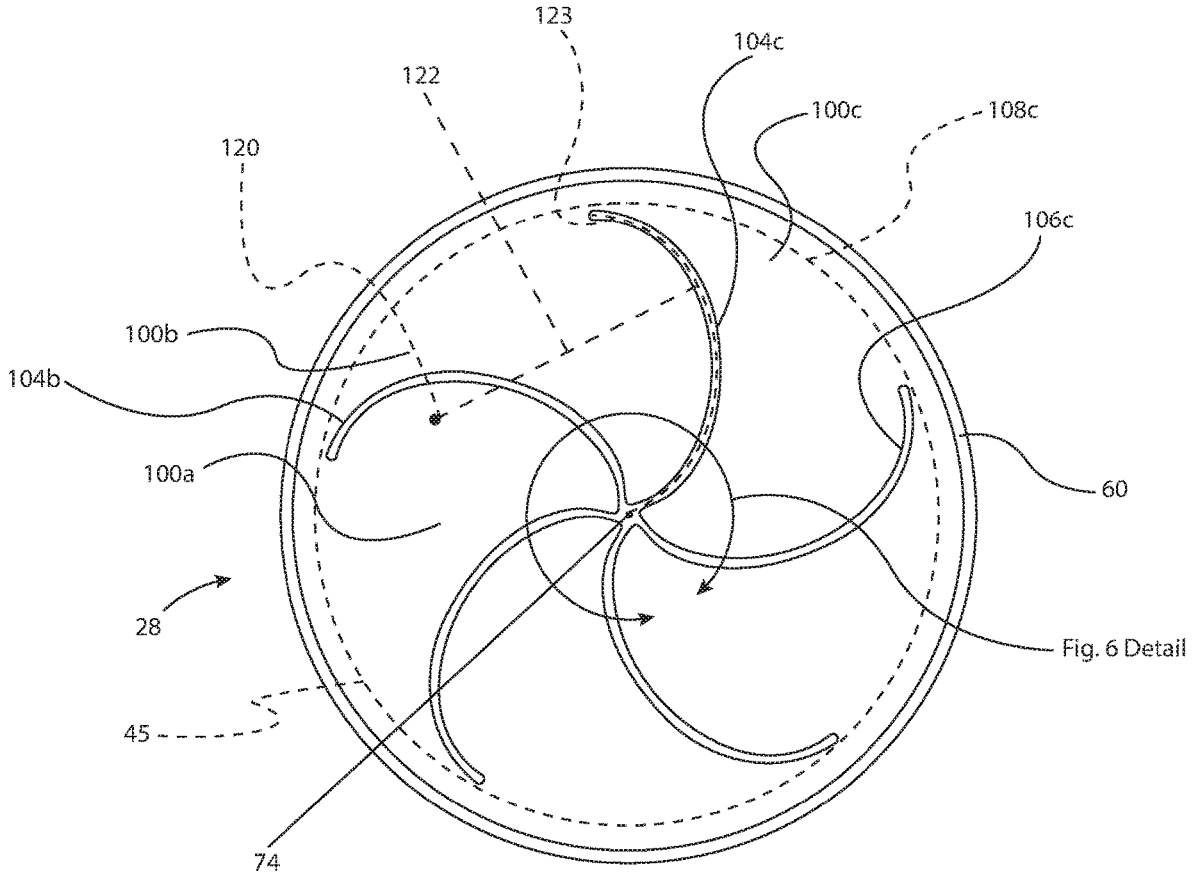
FIG. 3 is a top plan view of a container lid, according to various embodiments.
Figure 4:
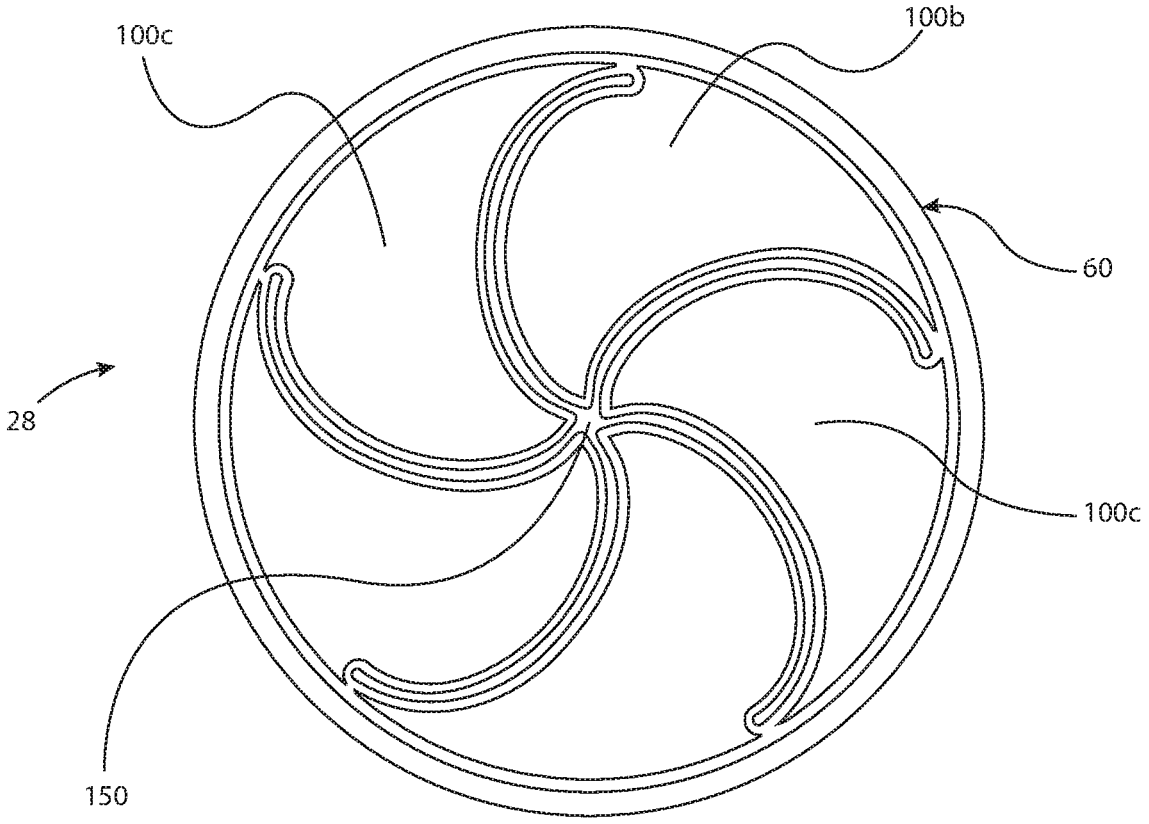
FIG. 4 is a bottom plan view of a container lid, according to various embodiments.
Figure 5:
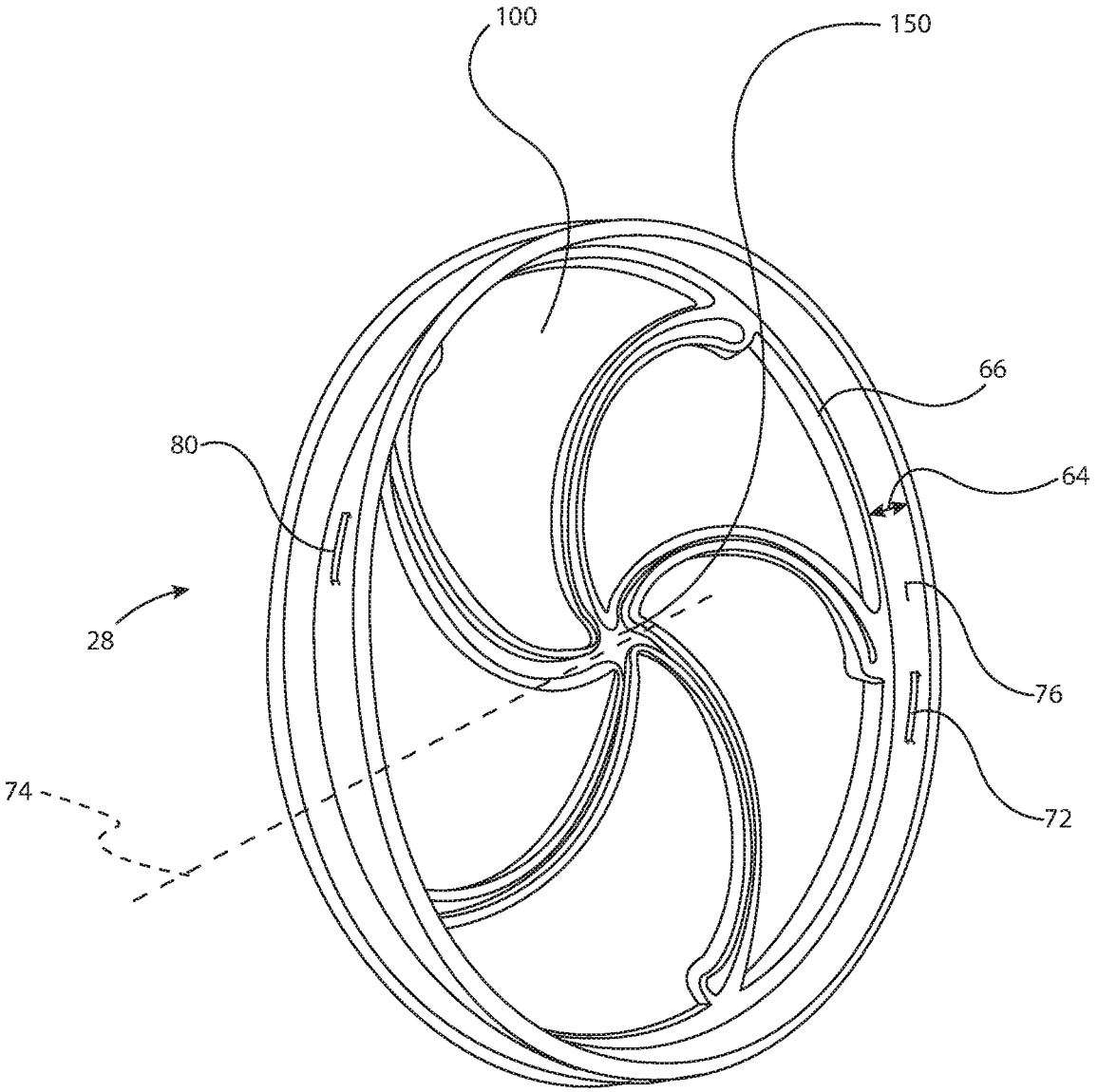
FIG. 5 is a bottom perspective view of a container lid, according to various embodiments.
Figure 6:
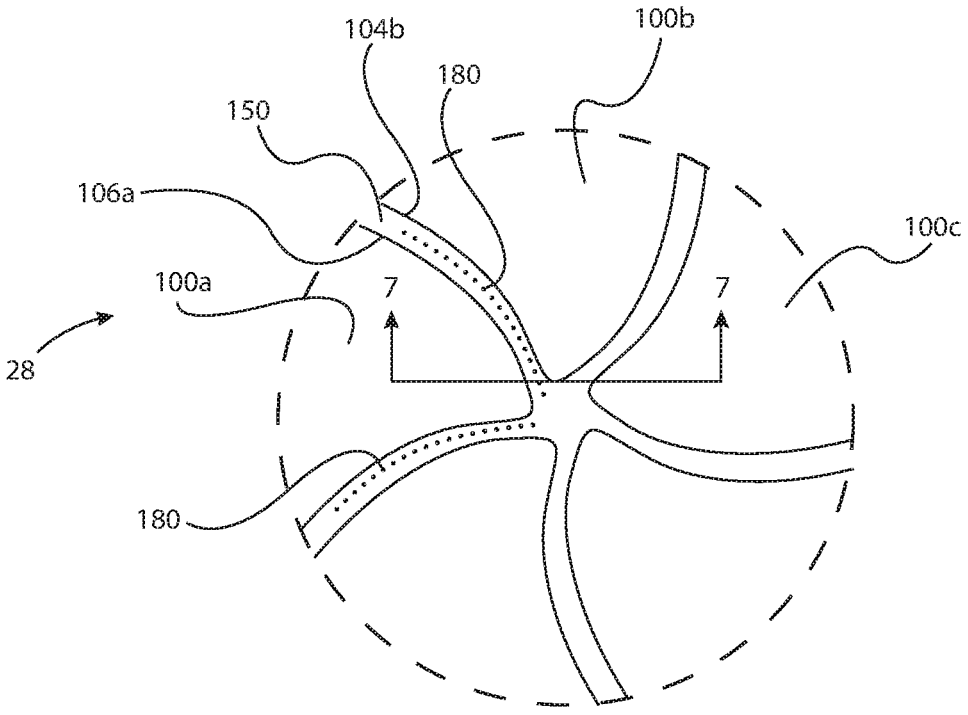
FIG. 6 is a detailed view of the container lid of FIG. 1 as indicated by circle 6 in FIG. 1.

With initial reference to FIGS. 1 and 2, a container assembly 20 is illustrated. The container assembly 20 includes a canister or a container 24, which may also be referred to as a container body, and a lid 28 that may also be referred to as a dispending closure, access control section or region. The lid 28 may be formed separately or as one piece with the container 24 to cover, in a selected manner, a container aperture 26 of the container 24. The container 24 may be generally rigid and the lid 28 may be or have flexible portions. The container 24 may be formed in any appropriate manner such as a blow molded process, injection mold process, extrusion, thermoform, or combinations thereof. The container 24 may be formed in any appropriate shape, and may include, for example as illustrated in FIG. 1, an elongated cylinder. The canister 24 may extend from a bottom end 32 (which may also be referred to as a first or second end) to a top end 34 (which may also be referred to as the other of the first or second end). It is understood that the top and bottom ends 34, 32 are merely exemplary and may be referred to as any appropriate terms regarding the ends of the container 24. Nevertheless, the lid or access panel 28 may be positioned at one of the two ends and is exemplary illustrated at the top end 34.

Extending between the two ends 32, 34 may be a side wall or a surface 38. In various embodiments, the side wall 38 may include a wall that extends from the bottom end 32 to the top end 34 and has a thickness that extends between an outer area or region (i.e. exterior of the container 24) and an interior of the container 24. The wall 38, therefore, may include an outer surface and an inner surface, as discussed further herein. Further, the bottom end 32 may include or be defined by a bottom wall 42 that may also have an exterior surface and an inner surface. Thus, an inner surface of the bottom wall 32 and the outer wall 38 may define an interior region, also referred to as an internal volume 46 of the canister or can 24. It is understood by one skilled in the art that the canister 24 may be provided in any appropriate shape and the cylinder as illustrated in FIG. 1 is merely exemplary. Further, the canister 24 may be formed of a selected material and the walls have selected thickness to allow for a water and/or air transfer elimination and a self-supporting structure.

Regardless of the shape of the canister 24, the lid or entry region 28 may be provided to cover or close the canister 24. For example, as discussed above, the canister 24 may include a container opening or aperture that is covered (e.g. closed and sealed) by the lid 28 and allows access to an internal region or volume 46 defined or formed by the various walls, such as the side wall 38 and the end wall 42, and may also be enclosed by the lid or top 28. The lid 28 may also include a closure aperture 45 that is closed or sealed by various portions of the lid 28, as discussed herein. The lid or top 28, therefore, may enclose the internal volume 46 of the canister 24.

The container assembly 20 may be closed to an external environment to maintain a selected environment in the internal volume 46 in a selected manner. For example, the container 20 may be substantially air tight, liquid tight, combinations thereof or both, and/or hermetically sealed. The lid 28 may be provided, therefore, to close or seal the internal volume 46 of the container assembly 20 relative to an exterior environment. Thus, a selected item or material may be positioned within the internal volume 46 and maintain in a selected state until the container assembly 20 is opened, as discussed further herein.

In various embodiments, the container assembly 20 may include or contain towels or towelettes that may be moistened to a selected degree with a liquid material. The liquid material, therefore, may be contained within the container assembly 20 and not allowed to dry relative to the exterior environment of the container 20 due to the sealing of the container 20 at the side wall 38, the end wall 42, and the lid or top 28. The container assembly 20, in a first configuration, is thus sealed with the lid 28.

With continuing reference to FIGS. 1 and 2, and additional reference to FIGS. 3-7, the lid 28 will be described in greater detail. The lid or top 28 may also be referred to as a closure mechanism of a closure section of the container assembly 20. The lid 28 may be formed integrally, such as substantially one piece, with the container portion 24. Accordingly, the lid 28 may be formed of the same material as the container 24, according to various embodiments. Alternatively, the lid 28 may be formed integrally with the container 24 and may be formed of a different material such as in a co-extrusion or co-molding process.

The lid 28 may also be formed separately from the container 24 and later connected to the container 24. For example, the lid 28 may include a side wall or skirt 60 that extends a distance 64 from a bottom surface or ledge 66 of the lid 28. The skirt 60 may include various mechanical locking features such as a locking tab or finger 72 that extends toward a center or central axis 74 from an internal surface or portion 76 of the skirt 60. It is further understood that a plurality of the tab 72 may be provide and/or a continuous ridge or rib may be provided rather than individual and distinct tabs. It is understood that the skirt 60 may also or alternatively include an external tab or finger 80 that extends away from the central axis 74 to engage the container 24. In various embodiments, therefore, the internal tab 72 may engage an external surface of the container 24 and/or the external tab 80 may engage an internal wall of the container 24. In various embodiments, either alone, separate, or in combination with the tabs or other mechanical connections, adhesives, welding, or the like may be used to connect the lid 28 to the container 24.

Regardless of the connection of the lid 28 to the container 24, the lid 28 may substantially seal the internal volume 46 of the container 24. The lid 28 may also be connected to the container 24 with additional items or sealing portions such as an O-ring and or sealant (e.g. adhesive). As discussed above, the lid 28 may provide a substantially air tight and/or liquid tight seal to the internal volume 46 of the container 24. In various embodiments, therefore, the lid 28 may provide a substantially liquid tight seal between an external environment and the internal volume 46 of the container assembly 20.

The container lid 28 may be formed of a selected material that can maintain a shape when a plurality of portions 100, which may be flexible portions or sections and also be herein referred to as leaves, petals, or fingers (individually referenced as 100 and a lower letter, e.g. 100*a* and 100*b* and 100*c*), are separated from one another along at least a first edge 104 and a second edge 106 (again, individually referenced with lowercase letters). Each of the petals 100 are hinged or flexibly connected along at least a third edge 108 relative to an outer surface or edge near the skirt 60.

The third edge 108 of all of the petals 100 may define or form the closure aperture 45. The closure aperture 45 may be selected to be similar to the perimeter of the lid 28 and include an area or perimeter dimensions substantially similar to that of the lid 28. For example, the closure aperture 45 may include a diameter of about 1 cm to about 20 cm, including about 3 cm to about 10 cm. It is understood, however, that the closure aperture 45 may be any appropriate shape. Generally, the closure aperture is sized to allow access to the internal volume 46 by a user's digits and/or hand.

In various embodiments, as illustrated in FIGS. 3-7, the petals 100 may include the two sides 104, 106 and extend from a third side or edge 108 near the skirt 60. Accordingly, each of the petals may be substantially triangular in shape or plan view. In various embodiments, however, it is understood that the lid 28 may include petals or portions 100 that are substantially non-triangular in shape. Further, the edges of the petals 100 may be curved, such that the first edge 104 and the second edge 106 curve around a center, such as a center 120 and form an arch. The edge 104c, therefore, may have a radius 122 and substantially formed along an arc 123 from near the central axis 74. The arc 123 of the edges may be about 1 cm to about 7 cm, including about 1.5 cm to about 5 cm. Further, each edge may form or be formed along a respective arc.

The petals may have the edges 104, 106 that curve from near the central axis 74. Thus, near the center 74, the petals may form an apex. Again, it is understood, that each of the petals 100 may be substantially triangular in shape and have substantially straight sides 104, 106. The arcuate sides or edges may allow for comfortable access to an interior volume 46 of the container 24, as discussed further herein.

Further the lid 28 may form at least an external dome or curve (i.e. convex) from a first edge 130, as illustrated in FIG. 1, to a second edge point 134. A dome or arcuate surface or contour 136 may be defined by an exterior surface of the petal 100 when they are in a substantially closed or sealed configuration. The dome may also have an apex at the center 74. The arc 136 may have an arc or curve that has a center 140 and a radius 144 from the center. The radius 144 may be any appropriate amount such as about 1 cm to about 10 cm, and further including about 3 cm to about 7.5 cm. It is understood, however, that the curve of the lid 28, or lid according to an appropriate embodiment, may include an internal curve or be concave.

Accordingly the lid 28 may be formed to have a substantially circular or annular outer edge, along which the skirt 60 may extend. The lid 28 may have an external dome or arcuate surface or contour 136 that extends away from the upper edge 34 of the container 24.

Regardless of the specific configuration of the lid 28, however, each of the petals 100 may be substantially connected to one another in at least a first configuration. With specific reference to FIGS. 6 and 7, each of the petals, such as the petal 100*a*, the petal 100*b*, and the petal 100*c*, may have an interconnecting portion or member 150 extending between the respective edges 104, 106 of the respective petals 100. The interconnection member 150 may also be referred to as a frangible border or member or portion and may be broken or opened, as discussed herein, to separate the various petals 100. The frangible member 150 may also be referred to as a frangible boarder. For example, the petal 100*a* includes the second edge 106*a* and the second petal 100*b* includes the first edge 104*b* extending between the respective edges 106*a* and 104*b* is the connecting surface or member 150. Accordingly, the first petal 100*a* and the second petal 100*b* may be substantially sealed relative to one another in a first sealed or closed configuration. The lid 28, however, may be opened at a particular or selected time to achieve a second configuration.

Figure 7:
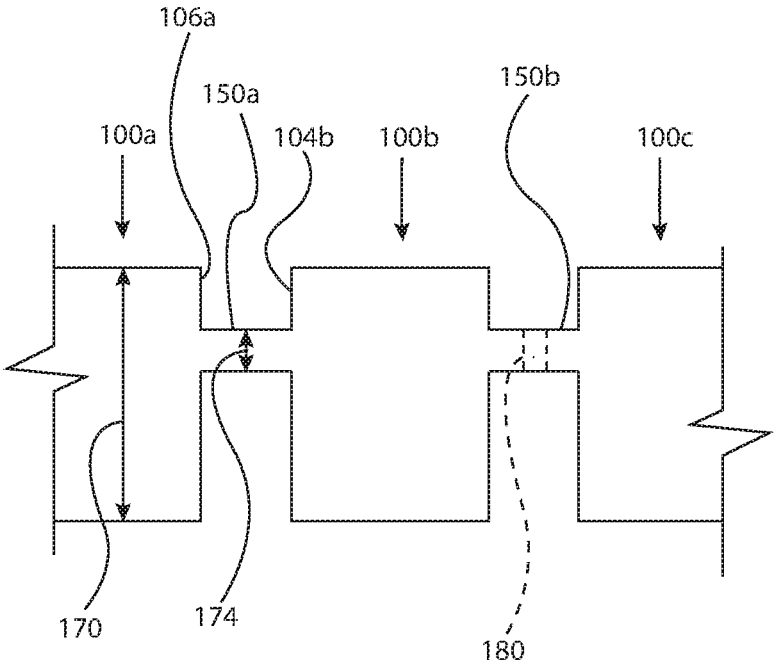
FIG. 7 is a cross-sectional view taken along lines 7-7 of FIG. 6.

The frangible portion 150, which may also be referred to as a thinned region and/or frangible wall, interconnects the respective petals and may also extend throughout every area of the lid 28 between each of the petals 100. As illustrated in FIG. 7, a cross-section relative to the respective petals 100*a*, 100*b*, and 100*c* illustrates the frangible portion 150 as frangible portions 150*a* and 150*b*. The frangible portion 150 may be understood to be a continuous piece or may be provided as separate members between each of the respective petals. In various embodiments, the lid 28 may be molded of a single material at a single time and the frangible portion 150 may be a thinned or small region relative to the petals 100.

In various embodiments, therefore, each of the petals, such as the petal 100a may include a height or thickness 170. The frangible portion 150*a* may include a height 174. The height 174 may be less than the height 170 of the leaves 100 and, therefore, provide a region that would break and/or tear easier in between the respective leaves 100. For example, the height or thickness 174 may be about 0.1 mm to about 3 mm, and further including about 0.25 mm to about 1.5 mm.

The petals 100 and the frangible portion 150 may have thicknesses 170, 174, respectively, which may vary depending upon the material from which the lid 28 is formed. In various embodiments, the lid 28 may be formed of a selected flexible and/or elastic polymer that may be deformed and returned to an original selected (e.g. molded) shape. The selected elastic and/or flexible polymer may include polypropylene, silicone, thermoplastic-elastomer, Low-density polyethylene, metallocene polypropylene, and/or Thermoplastic elastomers (TPE), latex, nitrile, nylon, Vinyl, polyvinyl chloride (PVC), or any flexible polymer, whether petroleum-derived or biologically-derived. In various embodiments, the lid 28 may be formed of a silicone or silicone like compound and the thickness of the petals 100 and the thickness of the frangible portion 150 may be selected based upon the properties of the silicone material. The silicone material may be substantially soft and smooth relative to a contact with skin of a user, such as a human user, and, therefore, may provide comfort to the user during use of the lid 28. The lid 28 may be formed of more than one material, as well. For example, the lid may include the skirt 60 formed of a first material and the petals a second material. Also, the lid 28 may be sealed to the container 24 with a selected separate member or material, such as an O-ring, sealing material, etc.

The lid 28 may also include various features to assist in allowing the frangible portion 150 to break relative to the respective leaves. For example, a weakened or thinned portion of the frangible portion 150 may also be provided. For example, a plurality of perforations 180 may be provided in the frangible portion 150 to assist in allowing the frangible portion 150 to break when pressure is applied from a user. The perforations 180 may include holes, scores or cuts formed through the frangible region 150 either during an injection or molding process and/or after molding the lid 28.

Figure 8:
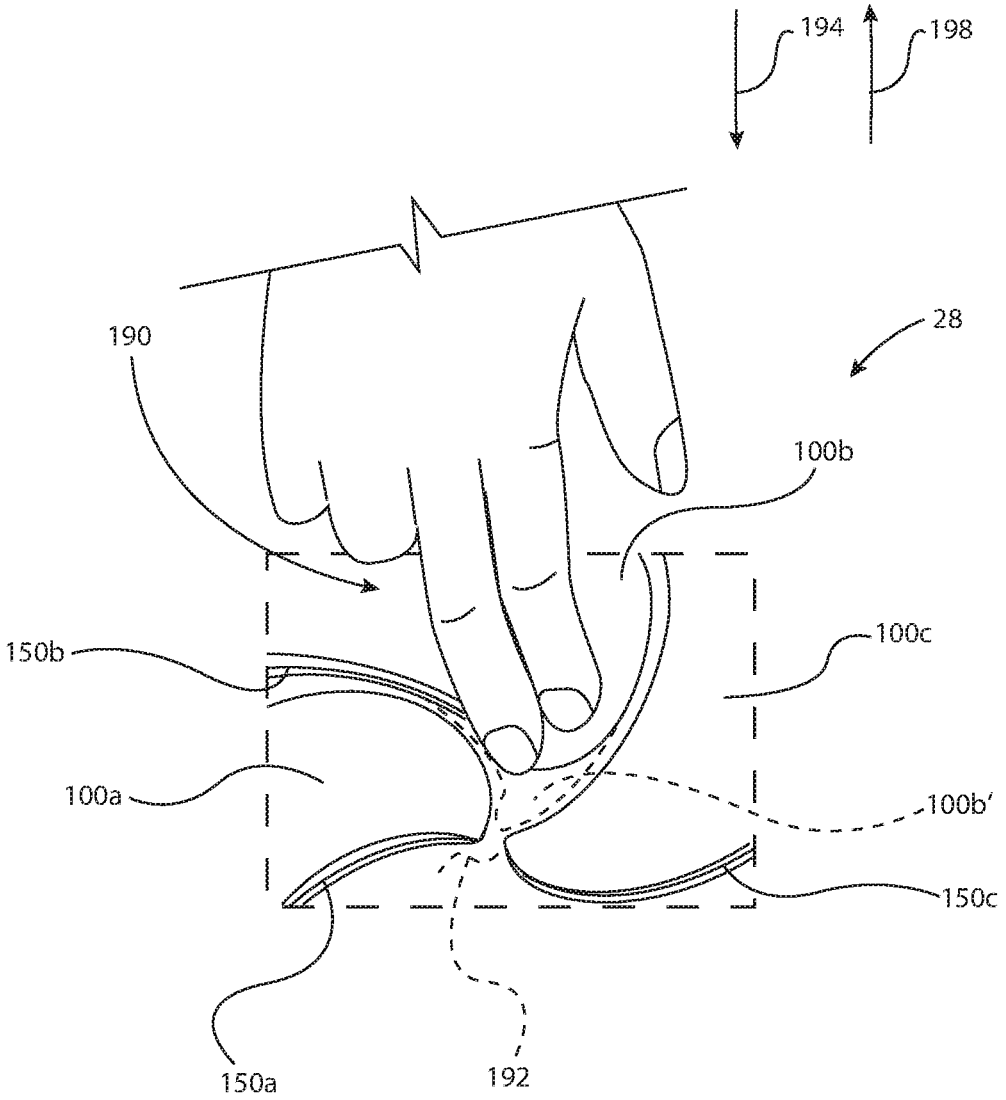
FIG. 8 is a detailed view of a use of the container lid of FIG. 3.

The lid 28 may be provided to the user in the canister assembly 20 in a substantially sealed configuration. As illustrated in FIG. 8, the frangible portion 150 may substantially connect the respective leaves that are adjacent or next to one another. The user, therefore, may engage a portion of the lid 28, such as near the central axis 74 and/or on one or more of the petals with one or more digits 190 of a hand. The digits or fingers 190 may apply a pressure to the lid 28 in a selected direction, such as generally in the direction of arrow 194. The pressure applied by the digits 190 onto the lid 28 may cause breaking of the frangible portions 150. The lid 28, therefore, may be opened by applying pressure by the digits 190 generally in the direction of the arrow 194 to break the frangible portion 150 between the respective petals 100. The user may then reach through the lid 28 to access the interior volume 46 within the canister assembly 20 through the closure aperture 45.

With continuing reference to FIG. 8, as the digits 190 are pressed through the lid 28 generally in the direction of arrow 194, the respective leaves, such as the leaf 100*b* will be pressed down into the canister 24. As the leaf 100*b* is pressed into the container 24, the frangible portion is configured to break upon the application of a selected force. Thus, the petal 100*b* may move from a sealed position or configuration 100*b*' to an open position, as illustrated in FIG. 8. Generally, the force may be easily applied by a user via one or more digits 190, but not so little as to be easily opening prior to inventoried first use. For example, force ranges to break the frangible portion 150 may be about one inch-pound (in-lb) to about 50 in-lbs, including about 1 in-lb to about 20 in-lbs.

As illustrated in FIG. 8, the frangible portion may break such that a portion of the frangible member 150 remains connected to the petal 100*b* as the broken frangible portion 150*b*. Also, portions of the frangible portion 150 may be connected to the respective other petals such as the frangible portions 150*a* and 150*c*.

As the digits 190 are pressed through the lid 28 moving the petals, such as the petal 100*b*, the interior volume 46 of the canister may be accessed. This allows a dispensing aperture or passage 192 to be formed. The dispensing aperture 192 may be opened for formed with the digits 190 of the user and may automatically close due to the elastic petals 100, as discussed herein.

Once the digits 190 move away from the lid 28, such as generally in the direction of arrow 198, the petals, such as the petal 100*b*, may rebound, such as substantially elastically, to the original or sealed configuration. Thus, the petal 100*b* may move to be adjacent or next to the respective petals, such as the petals 100*a* and 100*c* in a substantially closed configuration or manner after the digits 190 are removed from the lid 28. The petal 100*b*, therefore, along with the respective additional petals of the lid 28, may substantially automatically close the canister assembly 20 due to the rebound, such as in an elastic nature, of the petals 100.

In other words, the lid 28 may alone seal and close the container 24 when the frangible portions 150 are not broken. The frangible portions 150 may be broken by only pressure or force applied by the user. The petals 100 allow the user to apply pressure or force with the digits 190 to any selected area of the lid to break the frangible portions. Further, upon removal of the digits or the force therefrom, the petals may automatically close the lid 28 and, therefore, the container assembly 20. An additional or second lid is, thus, not needed to reclose the container assembly 20 and the lid 28 closes without a second or additional action of the user other than removing the force applied by the digits 190.

Although the frangible portion 150 may be broken after initial use or access of the interior volume 46, the lid 28 may close relative to an exterior environment once the digits 190 are removed. For example, the lid may allow the petals 100 to substantially contact each other along the respective edges 104, 106 to allow for a closing of the lid 28 to an amount of about 80% to about 100%, and further including about 85% to about 98%. Thus, passage of selected materials, such as atmospheric air or liquid may be slow and restrictive though the lid 28, even after the frangible portion 150 has been broken, such as while moving the digits 190 through the lid 28.

Accordingly, the lid 28 may allow for access to the interior volume 46 of the canister assembly 20 through the lid 28 with an efficient and substantially single actions (e.g. pressing on the petals 100 to break the frangible portion 150). The lid 28 may be sealed or substantially sealed in an initial configuration, such as in a packed, closed, delivered configuration. The lid 28 may then be opened at a selected time, such as by pressing through the lid 28 with digits of the user to break the frangible portions 150. An additional or over lid, such as snap lid, need not be provided to allow for a closing or substantial sealing of the interior volume 46 relative to an exterior environment with the lid 28. Further, as discussed above, the lid 28 may move from an open or accessed configuration to a substantially closed configuration due to an elastic rebounding, or other selected rebounding, of the portions of the lid 28. For example, each of the petals 100 may be provided with a living hinge relative to a portion of the lid 28, such as along the edge 108. In addition and/or alternatively to the living hinge, the material of the lid 28 from which the petals 100 are formed may be substantially elastic and flexible. Thus, the petals 100 may be biased to the closed or original configuration such that once the digits 190 are removed from the lid 28 the petals 100 rebound to the substantially closed configuration. As noted above, the petals 100 may rebound without additional action or effort of the user, i.e. automatically. In this way the lid 28 may move to a substantially closed configuration without the addition of an over lid or snap fit lid provided separate from or in addition to the lid 28 and the included petals 100.

With continuing reference to FIG. 1 and FIG. 2, and additional reference to FIGS. 9-12, a lid 28' is illustrated. The lid 28' may include features similar to the lid discussed above and illustrated in FIGS. 3-8, but may also include additional features or alternative features, as discussed further herein.

The lid 28' may include one or a plurality of petals 200, which may be individually identified by 200 with a lowercase letter, such as a first petal 200*a* and 200*b*. The petals 200 may also be flexible portions and also referred to as leaves, etc. The petals may extend from an outer or annular edge or collar 210. Similar to the collar 60, discussed above, the collar 210 may have a selected height 212 and may engage the container 24, similar to the lid 28 engaging the container 24. The lid 28' may also be formed of materials similar to those discussed above including polymers, including elastic polymers, silicone, or other appropriate materials. The lid 28' may also include various features, such as the petals 200 being elastically deformable or deformable such that they rebound to a selected configuration.

Figure 9:
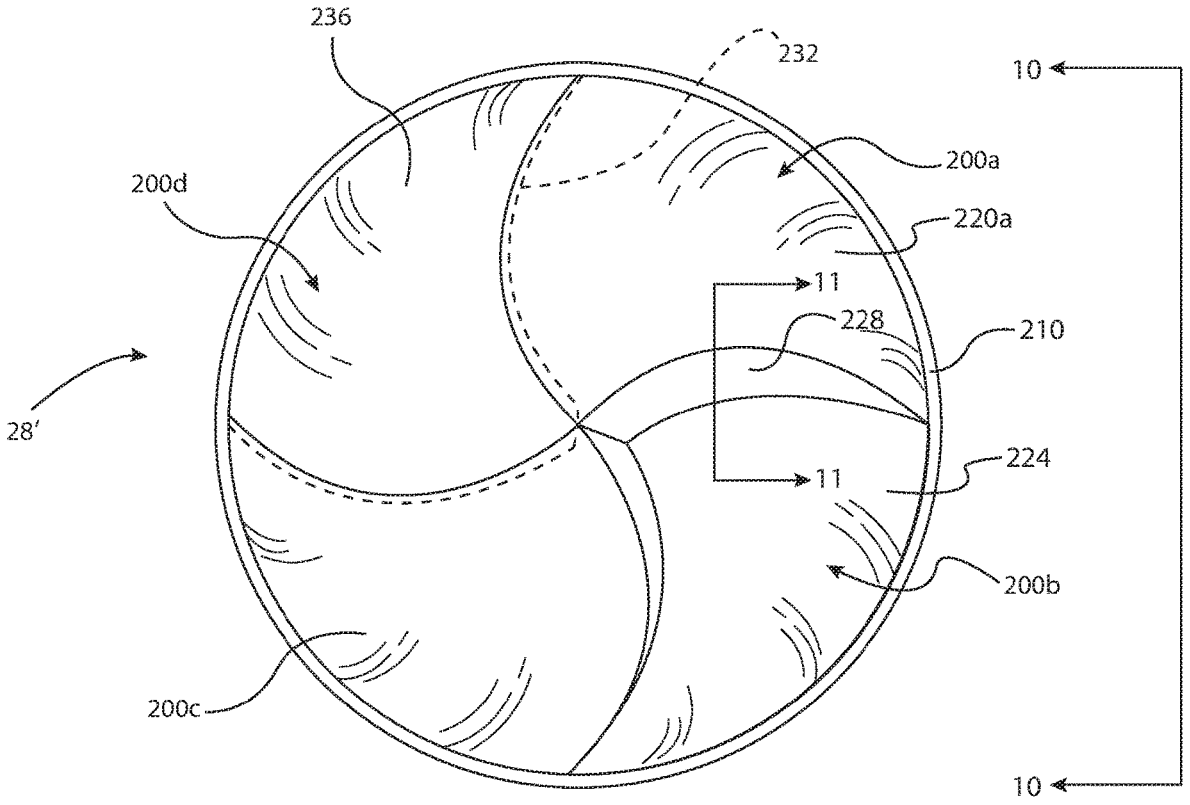
FIG. 9 is a top plan view of a container lid, according to various embodiments.
Figure 10:
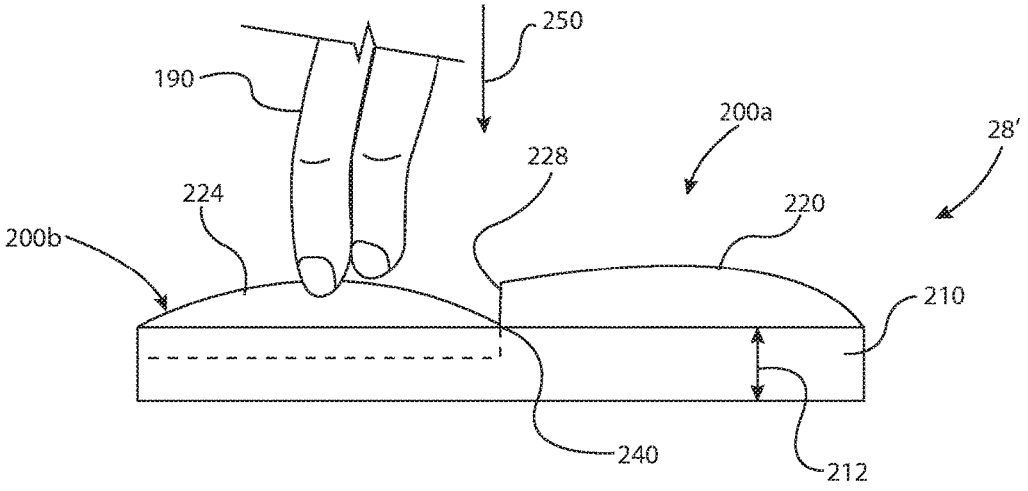
FIG. 10 is a side plan view from 10-10 of FIG. 9.

As illustrated in FIG. 9 and FIG. 10, the lid 28' may be provided in a substantially closed or sealed configuration. The lid 28' may be connected to the container 24 in a manner similar to the lid 28 as discussed above. Each of the petals 200 may have a selected thickness and may be provided at varying heights relative to one another. For example, as illustrated in FIG. 9, the petals 200*a* through 200*d* may be provided in alternating heights. The petal 200*a* may be a high petal while the petal 200*b* may be a low petal. The high petal 200*a* may have an upper surface 220 and the second petal 200*b* may have an upper surface 224. The first petal 200*a* may include a side wall or portion 228 that extends from the upper surface 220 to the upper surface 224 of the second petal 200*b*. The upper petal 200*a* may also have a second wall 232 that extends from the upper surface 220 to an upper surface 236 of the fourth petal 200*d*.

Figure 11:
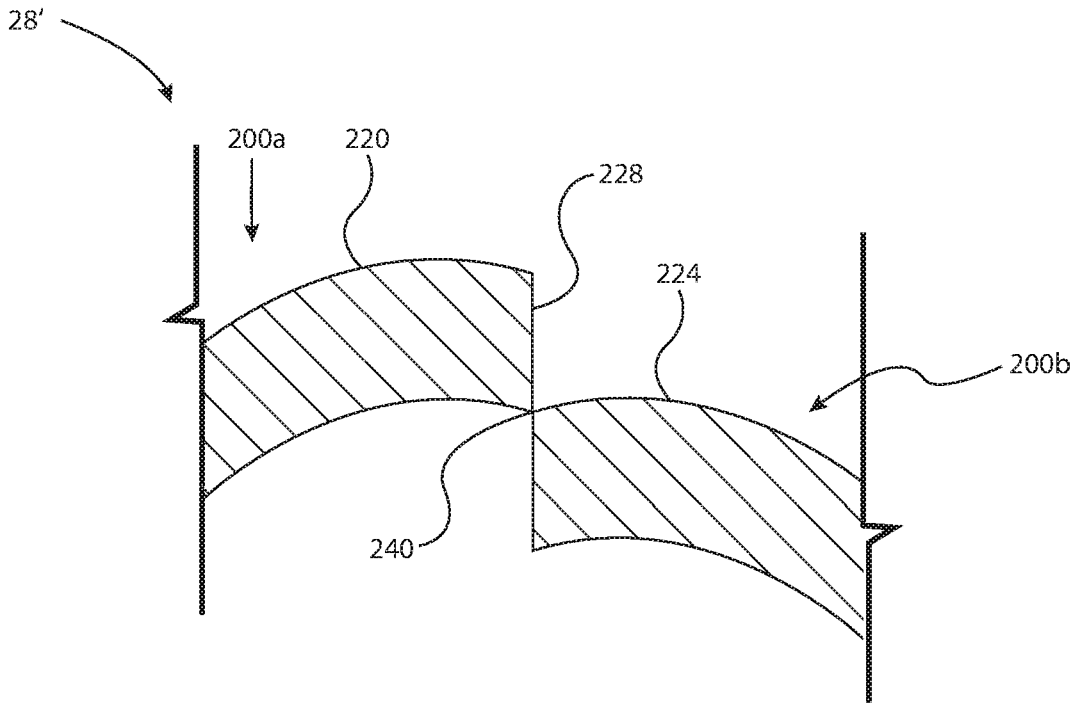
FIG. 11 is a cross-sectional view taken along lines 11-11 of FIG. 9.

With continuing reference to FIG. 9 and additional reference to FIG. 10 and FIG. 11, the wall 228 of the upper petal 200*a* may extend and contact substantially at an edge or portion 240 with the upper surface 224 of the second petal 200*b*. The edge or portion 240 may also be referred to as a frangible border or member or portion and may be broken or opened, as discussed herein, to separate the various petals 200. The frangible portion 240 may also be referred to as a frangible boarder or edge. The edge contact or edge contact portion 240 may provide a small or frangible region that may be easily broken or severed between the respective petals 200. For example, in a manner similar to that discussed above, the digits 190 may generally be moved in a direction of arrow 250 when pushing on one or more of the petals, such as the petal 200*b*.

Figure 12:
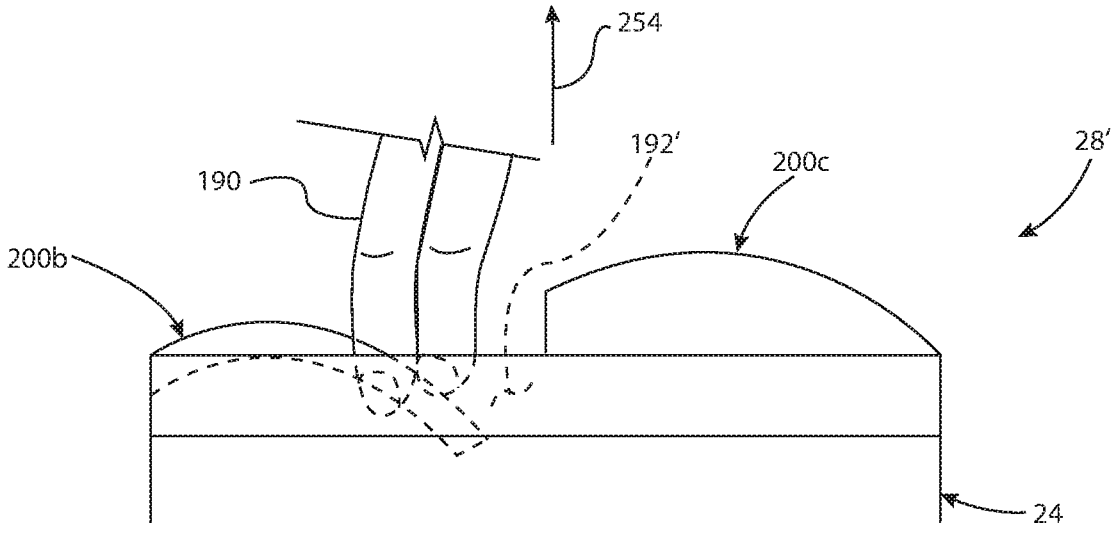
FIG. 12 is a side plan view of a lid being used, according to various embodiments.

Pushing on the petal 200*b* the frangible region 240 may break between the respective petals 200. Thus, the second petal 200*b* may be pushed into the container volume 42, as illustrated in FIG. 12, such that the petal 200*b* is pushed into the container volume 46 to open the lid 28'. This allows a dispensing aperture or passage 192' to be formed. The dispensing aperture 192' may be opened for formed with the digits 190 of the user and may automatically close due to the elastic petals 200, as discussed herein.

Upon release of the force of the digits 190, the petal 200*b* may rebound, such as generally in the direction of arrow 254. Upon rebounding or elastic returning of the petal 200*b*, the lid 28' may be substantially closed. Thus, the lid 28' may automatically close the internal volume 46 even after opening and unsealing a lid 28'. Thus, the petals 200 may be provided in a substantially similar or equal thickness, but in alternating height, to provide the frangible region 240.

As discussed above, the lid 28' may be provided on the container 24 to substantially seal the interior volume of the container 24 for further or later use. Upon opening of the container by breaking the frangible region 240, the user may access the interior volume 46 of the container 24. Once the user has accessed and removed material from the container 24, however, the petal 200*b* may rebound automatically and/or elastically to contact or be near the first petal 200*a*. Thus, the lid 28' may substantially close the internal volume of the container 24 after opening or unsealing the container 24.

Figure 13:
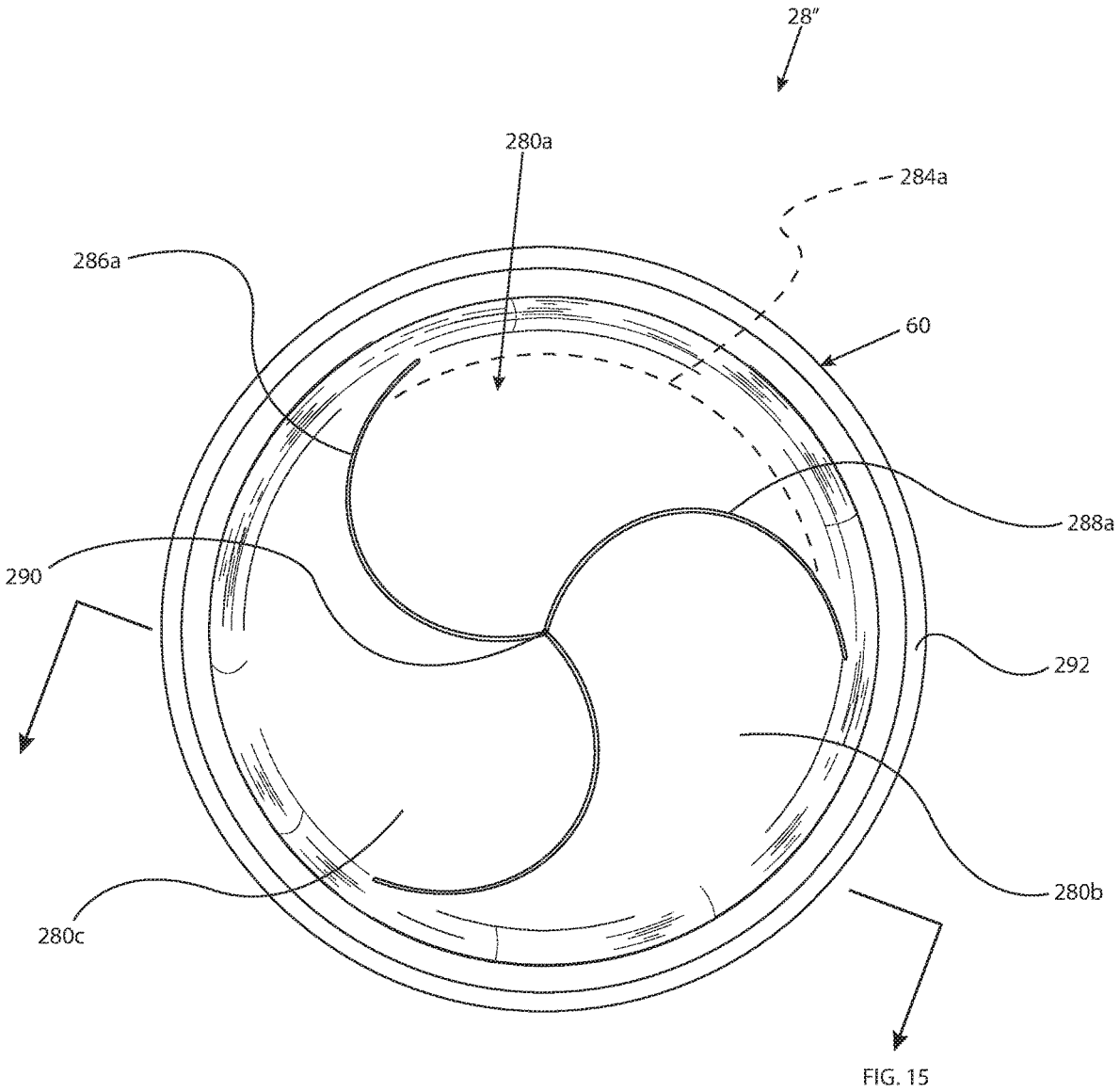
FIG. 13 is a top plan view of a container lid, according to various embodiments.
Figure 14:
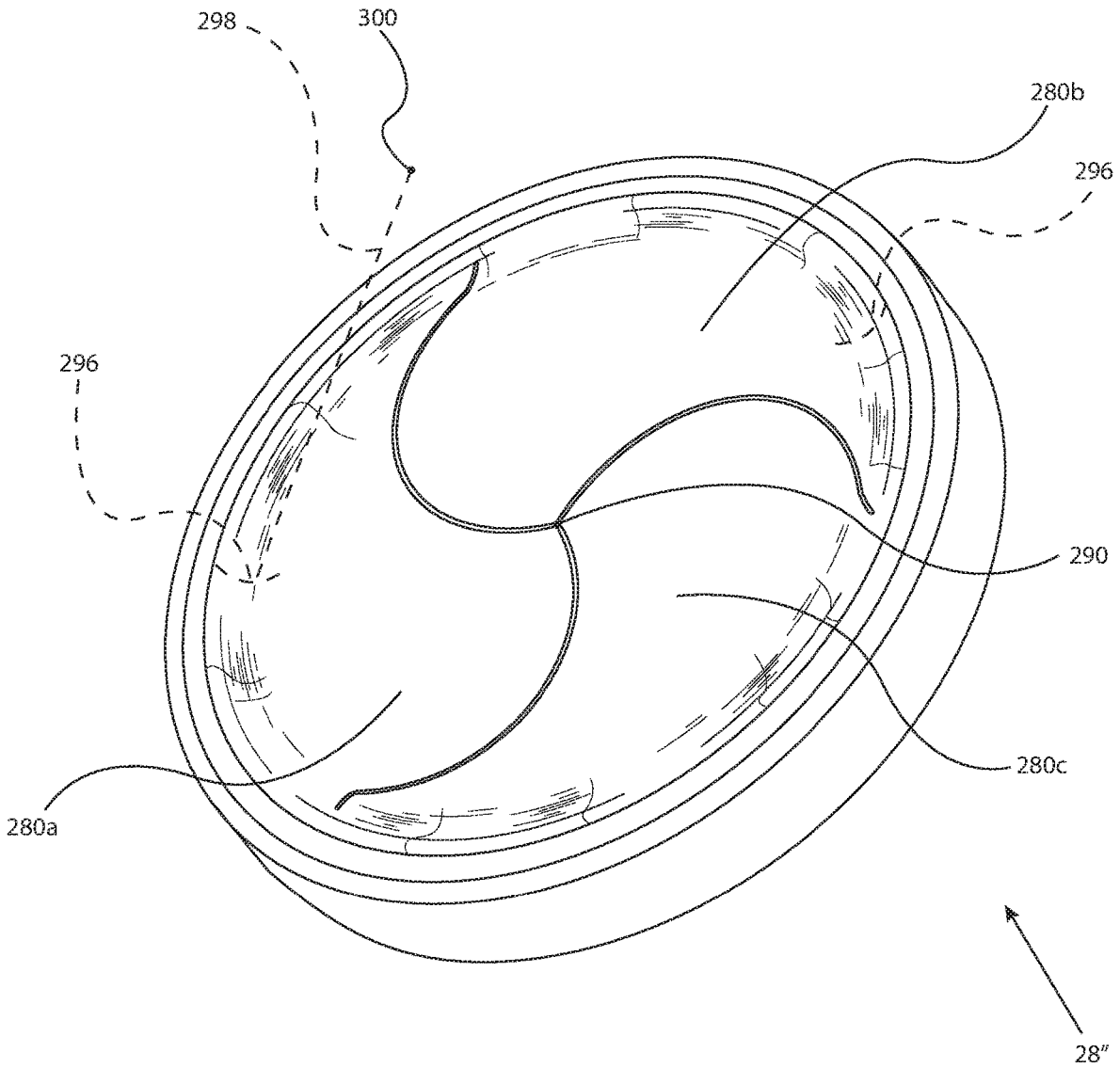
FIG. 14 is a top perspective view of the container lid of FIG. 13.
Figure 15:
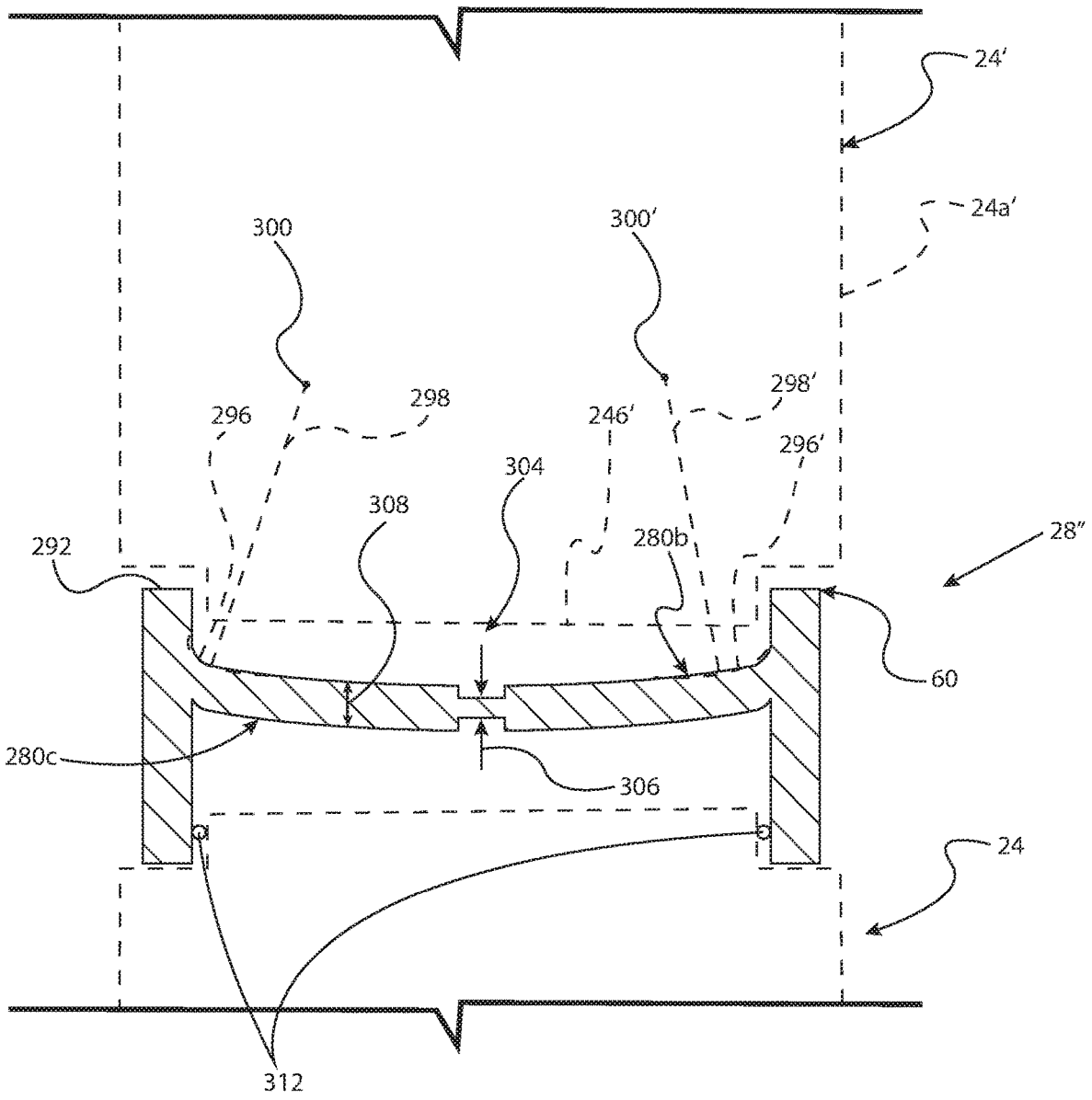
FIG. 15 is a cross sectional view of the container lid of FIG. 13 along line 15-15.

With reference to FIG. 13, FIG. 14, and FIG. 15 a lid assembly 28"" is illustrated. The lid assembly 28" may include portions similar to those discussed above, such as an outer edge or shoulder rim 60 that may be placed or fit around a portion of the container 24, as discussed above. Accordingly the lid 28" may be used in place or separate from the lids 28 and 28', discussed above. The lid 28", therefore, may also include one or more petals 280 that may also be referred to as leaves or flexible members (wherein each individual petal may be identified with a small letter). Accordingly, in various embodiments, the lid 28" may include three petals 280*a*, 280*b*, and 280*c*.

Each of the individual petals may flex relative to the outer edge or rim 60 at a selected flexion point or hinge, such as a hinge 284 for the petal 280*a*. Each of the petals 280, therefore, may include respective or appropriate flexing points. Further, each of the petals may extend along or have respective edges such as a first edge 286*a* and a second respective edge 288*a*. Each of the petals, such as the petal 280*a*, therefore, may flex relative to the edge or shoulder 60 in a manner or fashion as discussed above.

The lid 28" may include a concave configuration such that a center point or central region 290 may be lower than an upper edge or surface 292 of the shoulder 60. As illustrated in FIG. 15, therefore, the surface that forms the petal 280 may extend below or have a radius or curved upper surface 296 that extends along an arc that has a radius 298 that extends from a center point 300. The lid 28" may further include more than one curve radius. Thus, the lid 28" may further include a second curved portion having a second arc 296' that has a radius 298' extending from a second center point 300'. It is understood, however, that the second radius 298' may also extend from the first center point 300. Thus, the lid 28" may have a surface, such as an upper surface, that forms more than one radius, but is concave in overall configuration.

Each of the petals 280, such as at the respective edges 286, 288, may also have a border or portion 304, similar to the frangible wall 150, discussed above. The border 304 may also be referred to as a frangible border or member or portion and may be broken or opened, as discussed herein, to separate the various petals 280. The frangible wall or portion 304 may have a dimension or height 306 that is less than a dimension 308 of the respective petals 280. Therefore, the frangible wall or portion 304 may be broken under a selected force, such as with force applied with a digit, as discussed above.

The lid 28", therefore, may be provided to connect with or close the container 24, similar to the lid as discussed above. The lid 28" may seal the container 24 in a selected manner for maintaining an air tight and/or liquid tight environment within the container 24. In various embodiments, an additional sealing feature or portion may be provided between the lid 28", or lid according to any appropriate environment, and the container 24. As illustrated in FIG. 15, a sealing member or portion 312 may include an appropriate sealant such as a sealing member (e.g. O-ring), sealing adhesive, or other appropriate material. Thus, the lid 28" may be sealed to the container 24 in an appropriate embodiment.

Further the lid 28" may allow for nesting of a container into the concavity or region of the lid 28". As illustrated in FIG. 15, a second container 24' may include a side wall 24*a*' that has a selected region or portion 246' that may fit into or between the collar circumference of the lid 28". Therefore, a plurality of containers may be stacked one upon another. The concavity of the lid 28" and the shape and/or size of the bottom 246' may be fit into the lid 28" to allow for nesting of one container into the lid of another. Thus, the lid 28" may provide a system maintaining a selected stacking nature of the containers relative to one another.

Figure 16:
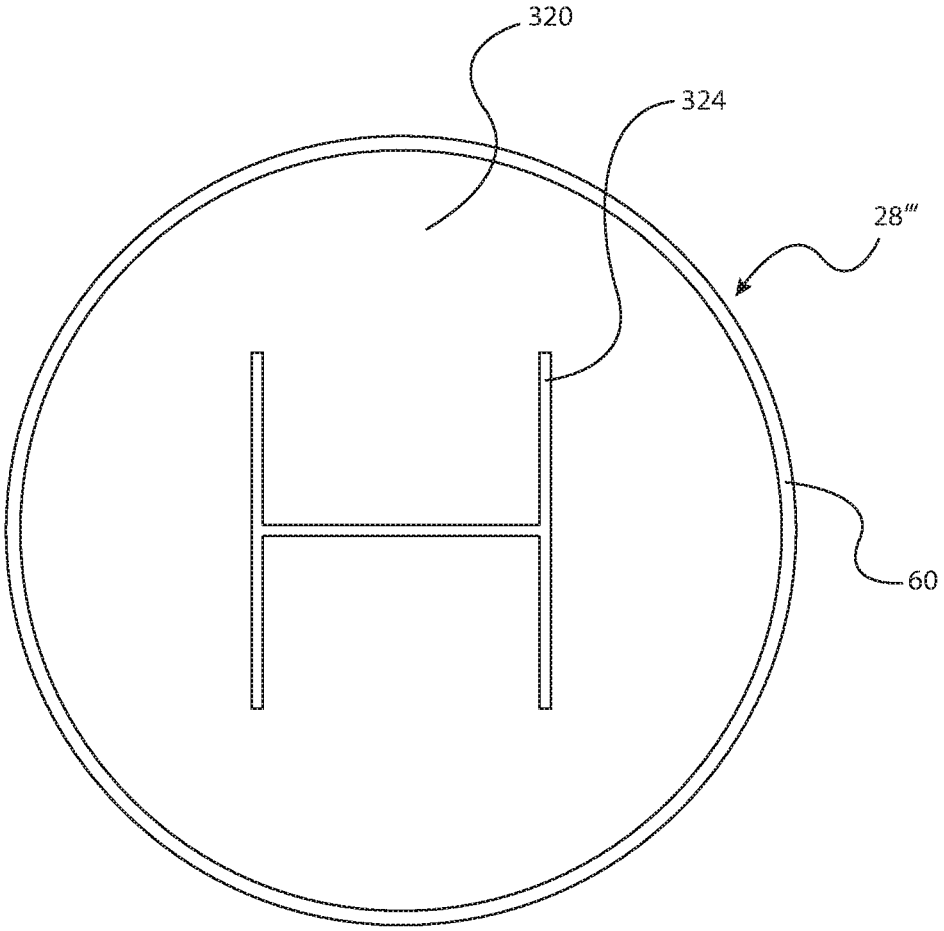
FIG. 16 is a top plan view of a container lid, according to various embodiments.

Turing reference to FIG. 16, a lid 28" is illustrated. The lid 28" may include features similar to those discussed above, such as an outer edge or collar 60. Extending from the edge or collar 60 may be one or more petals or flexible members 320. The flexible members or portions 320 may be a substantially continuous portion. The petal or flexible portion 320, however, may be interrupted by one or more frangible walls or portions 324. As discussed above, the frangible walls or portions 324 may be broken or severed upon the application of a selected force, such as applied with one or more digits. The frangible member or wall 324 may allow for one or more digits of a hand to pass through the lid 28"" to access a material and/or items within a selected container, such as the container 24, as discussed above.

The frangible wall 324 may allow for an opening or passage to be formed through the lid 28"". The flexible members or petals 320 may allow the lid 28"", however, to reclose in a selected manner and amount, as discussed above, after removal of the force from the lid 28"". Thus, the lid 28"" may allow for a selected sealing of the container 24 after an initial severing or breaking of the frangible wall 324.

The frangible wall 324, however, may be provided in a selected configuration within the lid 28"" including in a "H" configuration, as illustrated in FIG. 16. The frangible wall 324, therefore, may allow for access through the lid 28"". The flexible petals 320 may be provided extending around or forming the "H" shape that is defined by the frangible walls 324.

As discussed above, the lids, according to various embodiments, including the lid 28, 28', 28", and 28"" may allow for a selected sealing of the container 24, or a container according to any appropriate embodiment, in a selected manner. In various embodiments, such as those discussed above, the respective lids may seal the container in a substantially liquid tight manner. As an initial or delivered configuration the lid 28, alone (i.e. without an external or additional cover or sealing portion), may substantially liquid seal the container 24. Accordingly, a liquid or moist item placed within the container 24 may be maintained in a substantially sealed environment to maintain a selected volume of liquid or moisture content within the container 24.

After opening the lid 28, the lid alone, may selectively reseal or appropriately reseal or reclose the container 24. The petals or flexible portions, including those discussed above, may reclose or reseal the container 24. The flexible members alone may allow for or be the only closure of the container 24. Accordingly, the lid 28 alone and only including the selected petals or flexible portions, may close or provide a liquid or moisture closure for the container 24. One skilled in the art, therefore, understands that an additional member or portion (e.g. closure or top lid or cap) need not or is not provided to appropriately or selectively seal or maintain a moisture content within the container 24 even after opening or breaking of the frangible walls or portions, as discussed above. Thus, the lid 28, according to various embodiments, may be provided to be the only mechanism or system or item to close the container 24 to maintain a selected moisture content within the container 24 after the frangible or openable portions are opened by a user.

In various embodiments, the lid 28, 28', 28" may be provided that may be substantially sealed such that an internal volume 46 of the container 24 may be sealed relative to the external environment. The lid 28, 28', 28" may substantially fluidly seal the container 24 to an exterior environment. The lid 28, 28', 28" may also include a selected frangible portion that may be broken or allow the lid 28, 28', 28" to be opened upon pressure by the user without first or removing a second or external lid or cap. Further the lid 28, 28', 28" may include a selected feature such as an elastically deformable member and/or living hinge portion to allow the selected petal to return to a substantially closed configuration, from an open configuration, to again close the container. After the lid 28, 28', 28" is first opened it may return to a substantially closed orientation or configuration such that the lid is substantially closed or limits transfer of an external environment (e.g. atmosphere) into the container volume 46 and/or escapement of material from the interior volume 46 (e.g. via evaporation) from the container volume 46.

In addition, the lids, according to various embodiments, may include a generally or substantially planar or flat portion. For example, the lid 28" may include the concave portion or surface 296 and the remaining extent of the lid, such as the surface referred to as 296', may be substantially planar. Thus, the lid 28" may include a planar portion. Further, the lids, according to various embodiments, may be substantially planar across an entire extent of the lid such as from edge to edge 60 across the lid.

Figure 17:
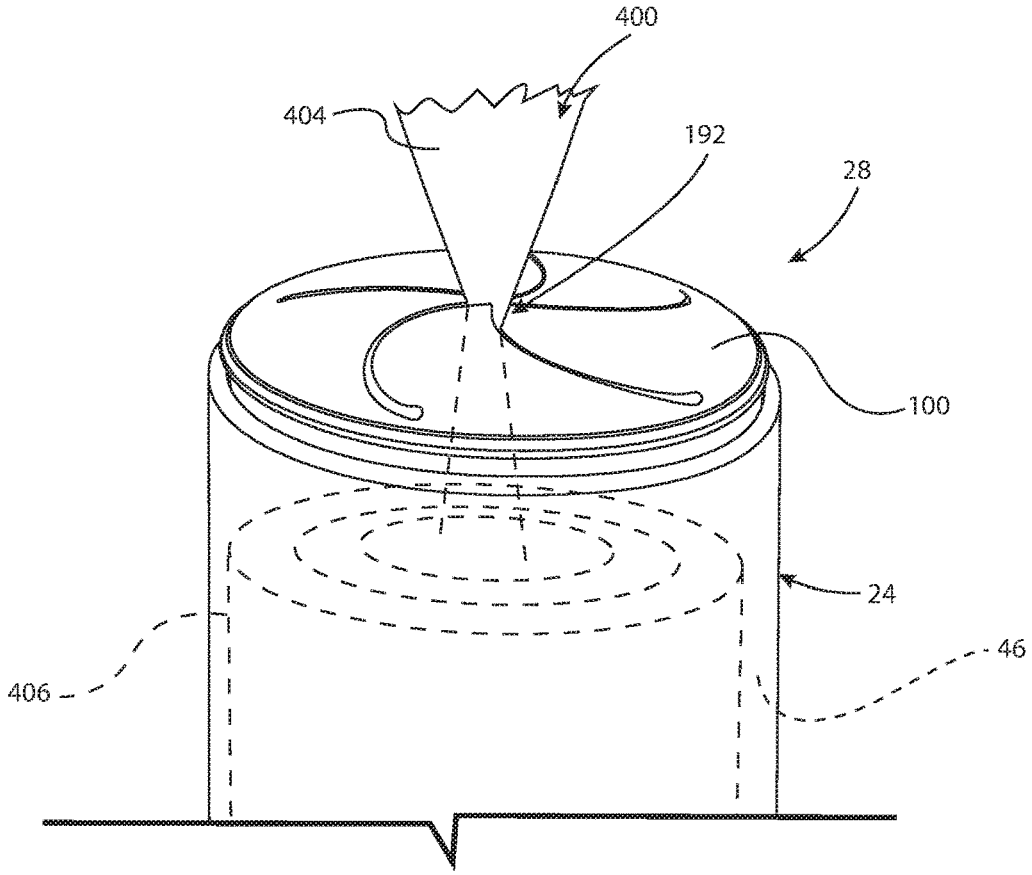
FIG. 17 is an in use view of the container assembly of FIG. 1.
Figure 18:
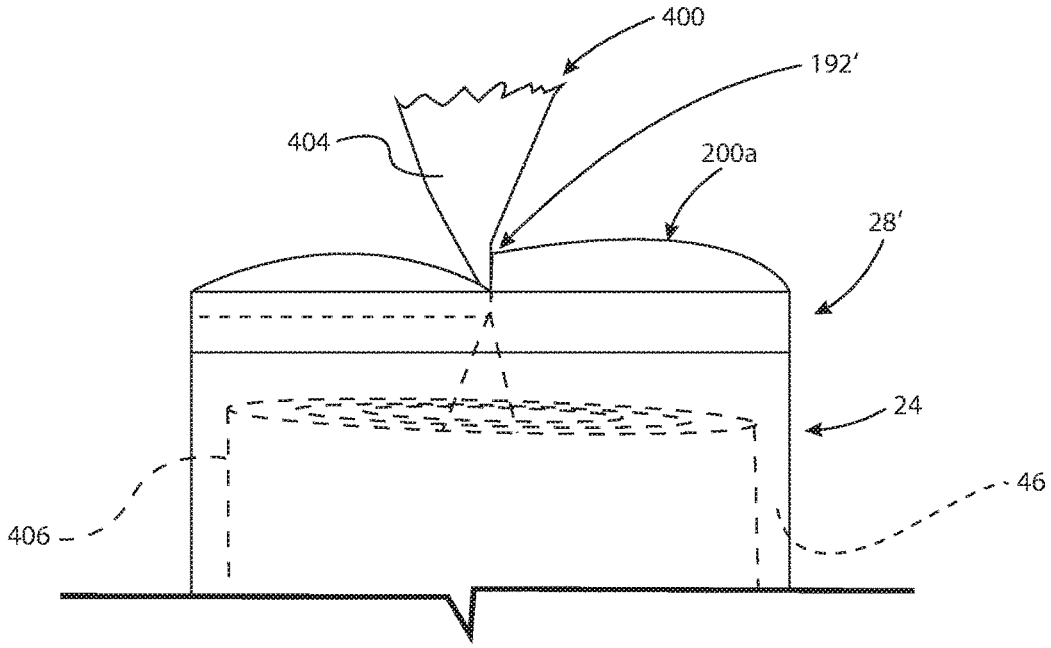
FIG. 18 is a container assembly in use view including the lid of FIG. 9.

Turning reference to FIGS. 17 and 18, a selected item may be removed from the container 24 through the respective lids 28, 28', 28". In various embodiments, one or more connected or frangibly connected towelettes 400 may be removed through the lid 28, 28', 28" between the respective petals 100, 200. The towelettes 400 may also be referred to as wipes and may be wetted or moistened (e.g. wet wipes). A plurality of the wipes 400 may be formed as a donut within the volume 46. The wipe 400 may be dispensed through the lid 28, 28', as discussed herein, through a dispensing aperture of the lid 28, 28'

As illustrated in FIG. 17, a withdrawn towelette portion 404 may extend through the area between the respective petals 100 and may be selectively connected to a plurality of towelettes 406 within the container 24. The towelettes 406 may be moistened with a selected material, such as a selected cleaning agent. The withdrawn towelette portion 404 may be withdrawn through the lid 28 between the respective petals 100. The area between the petals 100 may also be referred to as a dispensing aperture.

Due to the rebound effect (e.g. elastic in nature), however, of the petals 100, the withdrawn portion 404 of the towelettes 400 is maintained relative to the lid 28 and the lid 28 remains substantially closed relative to the internal volume 46 of the container 24. The withdrawn portion 404 may be referred to as a lead wipe and is maintained in the dispensing aperture due to the reclosing of the petals 100. Further, the wipes 400 are formed or connected together so that a following wipe will follow the lead wipe when pulled by the user. The petals 100, however, may form or generate a drag or friction of the toilets to reduce or eliminate roping such that the wipes are dispensed individually and become disconnected.

In a similar manner, the petals 200 of the lid 28', as illustrated in FIG. 18, can be substantially close to one another such that the exposed towelette portion 404 is held between the respective petals. The remaining or internal towelettes 406 may be held within the internal volume 46 of the container 24 in a manner similar to that discussed above. The wipes 400 may be dispensed though the lid 28' in a manner similar to the lid 28, as discussed above.

In either the lid 28 or the lid 28' the wipes or towelettes 400 may be held within the container 24 while the lid 28, 28' is substantially closed relative to the container 24. As discussed above, the lid 28, 28', after having the respective frangible portions 150, 240 broken, but in the closed configuration may include an open area of less than about 80% of the upper surface area of the respective lids 28, 28'. It is understood that the amount open may be between about 0% and about 5%, including about 1% to about 3%. Thus, the respective lids 28, 28' may substantially close the container 24 to an external environment based upon rebounding or elastic returning of the respective petals 100, 200 without any additional lids or covers.

As discussed above, in various embodiments, the lid or dispensing closure may be formed and/or provided. The dispensing closure may be made of a flexible resin material. The lid may be formed with a container or connected thereto as a separate piece. The lid may be convex, as discussed above, but may also include a concave or flat configuration. Further, the lid may be formed of selected materials, as discussed above.

The lid, however, generally includes a dispensing aperture that is initially or may be closed and sealed with one or more petals and a frangible portion or wall formed adjacent thereto. The petals may include a flexible portion or hinge. A user may break the frangible portion to reach through the dispensing aperture to retrieve one or more items (e.g. wipes) from the container.

The lid may include a plurality of the petals. The frangible portion may be formed adjacent to an edge of each of the petals. Thus, a user may break more than one frangible wall to break the seal and retrieve the items form the container.

The petals may include a hinge or formed with an elastic material to return to the closed configuration once the users hand is removed. The petals may close, to a selected degree, the dispensing aperture after the seal is broken. As noted above, the closure may cover at least about 80% of the aperture, including about 90%, and further including about 95% to about 99%. The closed configuration may eliminate or slow drying of items within the container. The lid, therefore, does not require and need not include a separate or additional cover to cover the dispensing aperture.

In the closed configuration, the lid may also apply a force to the items, such as the towelettes or wipes. The force applied by the lid may cause individual towelettes to separate from each other. Thus, a lead towelette may be separated from a following towelette or wipe by the force applied by the lid. Thus, roping of the wipes may be reduced or eliminated.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A wipes dispenser comprising:

(a) a container comprising: a container body and a dispensing closure forming an interior region configured to contain a plurality of wipes that are interconnected such that pulling on a lead end of a lead wipe of the plurality of wipes causes a following wipe of the plurality of wipes to also be pulled and follow the lead wipe;

(b) a container aperture defined by the container body and configured to be covered by the dispensing closure;

(c) two or more flexible sections of the dispensing closure;

(d) one or more frangible borders that join the two or more flexible sections together in a first configuration to form a single piece dispensing closure; and (e) a dispensing aperture formed between the two or more flexible sections when the frangible borders are broken by a user in a second configuration to allow for dispensing of the wipes;

(f) wherein the dispensing aperture is sized to allow one or more digits of a hand to reach through the dispensing aperture to access the interior region;

wherein the container body and the dispensing closure form a liquid-tight sealed interior region in the first configuration; and wherein the container includes no additional lid portion in addition to the container body and dispensing closure to form the liquid-tight sealed interior region.

2. The wipes dispenser of claim 1, wherein the plurality of wipes are formed in a roll in the shape of a donut.

3. The wipes dispenser of claim 1, wherein the flexible sections are elastic and configured to automatically close after opening in the second configuration, wherein the frangible borders have a first thickness and the two or more flexible sections have a second thickness in the first thickness less than the second thickness.

4. The wipes dispenser of claim 1, wherein the flexible sections have three sides.

5. The wipes dispenser of claim 1, wherein each of the flexible sections have a first curved side and a second curved side that extend toward an apex of each flexible section.

6. The wipes dispenser of claim 1, wherein the dispensing closure is made of a flexible and/or elastic polymer that may be deformed and returned to an original selected shape.

7. The wipes dispenser of claim 1, wherein the dispensing closure is made of flexible polymer including at least one of a thermoplastic-elastomer, a low-density polyethylene, and/or silicone.

8. The wipes dispenser of claim 1, wherein the container body and the dispensing closure form a sealed internal volume.

9. The wipes dispenser of claim 8, wherein the container body is a blow-molded plastic container.

10. The wipes dispenser of claim 8, wherein the container body is an injection molded plastic container.

11. A wipes dispenser comprising:

(a) a container body defining an interior region and a container aperture;

(b) a dispensing closure configured to selectively close the container aperture;

(c) a moisture seal formed around the container aperture;

(d) two or more sections of the dispensing closure configured to elastically flex in a second configuration relative to the container body;

(e) one or more frangible portions that join the flexible sections together in a first configuration to form a single piece dispensing closure; and (f) a dispensing aperture that is created when the frangible portions are broken by a user in the second configuration to allow for the dispensing of wipes;

wherein the container body and the dispensing closure form a liquid-tight sealed interior region in the first and second configuration; and wherein the wipes dispenser container includes no additional sealing portion in addition to the container body and dispensing closure.

12. The wipes dispenser of claim 11, wherein the interior region is configured to contain a plurality of wipes that are interconnected such that pulling on a lead end of a lead wipe of the plurality of wipes causes the following wipe of the plurality of wipes to also be pulled and follow the lead wipe;

wherein the plurality of wipes are a roll of wipes in the shape of a donut.

13. The wipes of the dispenser of claim 11, wherein the flexible sections extend toward one another;

wherein the flexible sections are elastic and automatically reclose to a closed configuration after opening;

wherein the reclosed flexible sections are configured to retain moisture in the dispenser in the closed configuration;

wherein the one or more frangible portions are a thinned region that retain the flexible sections together and are configured to be breakable by a user to separate the one or more frangible portions.

14. The wipes dispenser of claim 11, wherein the flexible sections are three sided.

15. The wipes dispenser of claim 11, wherein the flexible sections have a first curved side and a second curved side that join at an apex.

16. A wipes dispenser comprising:

(a) a container comprising: a container body and a dispensing closure forming an interior region configured to contain a plurality of wet wipes that are interconnected such that pulling on a lead end of a lead wipe of the plurality of wipes causes a following wipe of the plurality of wipes to also be pulled and follow the lead wipe;

(b) a container aperture formed by the container body;

(c) three or more flexible sections of the dispensing closure that extend toward one another;

(d) three or more frangible borders that join the flexible sections together in a first configuration to form a single piece sealed dispensing closure to seal the interior region in the first configuration; and (e) a dispensing aperture that is created when the frangible borders are broken in a second configuration by a user to allow for the dispensing of the wipes;

wherein the flexible sections are elastic and automatically reclose after opening in the second configuration forming a liquid-tight seal to contain moisture within the dispensing container without any additional lid around the dispensing aperture.

17. The wipes dispenser of claim 16, wherein the dispensing closure is substantially planar.

18. The wipes dispenser of claim 16, wherein the flexible each sections have three sides, wherein two of the three sides include two frangible borders that are configured to be broken in the second configuration.

19. The wipes dispenser of claim 16, wherein the flexible sections have a first curved and second curved side that join at an apex.

* * * * *